United States Patent [19]

Makoe

[11] Patent Number: 4,658,106

[45] Date of Patent: Apr. 14, 1987

[54] LOCK-OPERATED CUT-OFF SWITCH FOR ELECTRONICALLY OPERATED DOORS

[76] Inventor: Michael Makoe, 20 Charles St., Lodi, N.J. 07644

[21] Appl. No.: 825,150

[22] Filed: Feb. 3, 1986

[51] Int. Cl.[4] ..... H01H 27/00; H01H 3/16

[52] U.S. Cl. ..... 200/61.64; 200/61.67; 200/61.68; 200/61.7

[58] Field of Search ..... 200/61.62–61.7, 200/61.76–61.83

[56] References Cited

U.S. PATENT DOCUMENTS

| | | | |
|---|---|---|---|
| 483,739 | 10/1892 | Green | 200/61.68 |
| 1,104,734 | 7/1914 | Lee | 200/61.68 |
| 1,626,357 | 5/1927 | Townley | 200/61.68 |
| 1,630,081 | 5/1927 | Flekstein | 200/61.63 |
| 1,702,483 | 2/1929 | Phelps | 200/61.68 |
| 1,744,333 | 1/1930 | Pfaffenberger | 200/61.7 |
| 2,301,290 | 11/1942 | Knight | 200/61.68 |
| 2,467,815 | 4/1949 | Curtis, Jr. | 200/61.68 |
| 4,091,866 | 5/1978 | Curatolo | 165/138 |
| 4,189,692 | 2/1980 | Bonnar | 335/205 |
| 4,333,604 | 6/1982 | Petrillo | 236/46 R |

*Primary Examiner*—J. R. Scott

*Attorney, Agent, or Firm*—Martha G. Pugh

[57] ABSTRACT

A lock-activated cut-off switch for use in connection with electrically operated overhead garage or roll-up warehouse doors. The switch of the present invention takes the form of a spring-biased, counter-weighted, wedge-shaped, trap door or gate disposed to close against the switch frame having an opening which is lined up with the opening constructed to receive the lock bolt or bar when the lock is actuated. A pair of conducting wires which respectively terminate on contacts at the lower end of the frame on opposite sides of the opening are electrically connected through contacts and a conductor on the trap door or gate, when the gate is closed, and are instantly disconnected when the trap door or gate is opened by actuation of the lock bar or bolt. This breaks the circuit to the electrically controlled operator disabling the mechanism for opening and closing the garage doors.

6 Claims, 8 Drawing Figures

LOCK-OPERATED CUT-OFF SWITCH FOR ELECTRONICALLY OPERATED DOORS

BACKGROUND OF THE INVENTION

This relates in general to lock-controlled switches for electrically operated doors, more particularly, to lock-controlled switches for use on electrically operated upward acting doors of the types used in garages and warehouses.

Large numbers of garage doors and warehouse doors are equipped in the present state of the art to be opened and closed by an electrical operator in response to remotely-controlled signals. When such operators are installed on doors, the locks on those doors are often either removed or disabled. This renders the door more accessible to a forced entry. If the locks are left operable the guarantee is cancelled by the installation company. For this reason, many insurance companies insist that such remotely-controlled electrically operated doors be locked manually in order to avoid the possibility of the doors being forced open by burglars and other unauthorized persons. Since it is difficult for one using an electrical operator responsive to remotely-controlled signals to determine whether or not a door has been manually locked, every year millions of dollars worth of damage is done because doors are locked, and the locks, sections, and tracks are damaged when the electrical operator is remotely engaged.

Although several lock-out switches are available in the prior art for disabling electrical operators for opening and closing garage doors, they are complex and expensive to produce and install. Furthermore, many of the available prior art switches of this type have several operational disadvantages. For example, in many such switches, there is a dead point at which the lock is engaged, but the electrical operator is still operational. A further disadvantage which is characteristic of most types of such prior art switches is that the 'throw' of the switch is limited, so that the switch has to be custom designed for locks having bolts or bars of different sizes, which traverse paths of different lengths.

SHORT DESCRIPTION OF THE INVENTION

Accordingly, it is the principal object of this invention to provide certain improvements in lock-operated cut-off switches, more particularly, to provide an improved switch for temporarily disabling the electric operator control means from opening a door which has been manually locked, thereby saving the lock, door, track, and the electric operator control means from damage.

A second object of the invention is to provide a lock-actuated cut-off switch which operates substantially instantaneously upon contact by the lock bolt or bar to cut off power to the electrical operator.

A third object is to provide a cut-off switch for electrically operated overhead type garage and roll-up warehouse doors which is simple and inexpensive to install.

A fourth object is to provide a switch which requires a minimum of space to install.

In accordance with the present invention, these and other objects, are realized in a switch comprising a lock-actuated, spring-biased, counter-weighted, wedge-shaped trap door or gate which is connected in circuit relation to the electrical operator which actuates a driving mechanism for opening or closing a garage or warehouse door. In a preferred embodiment, the switch is designed to fit over the lock hole through which the lock bar or lock bolt is designed to pass. When the lock is implemented, as, for example, by turning a key, the bar or bolt passes through the lock hole, pushing open the trap door or gate, thereby instantaneously breaking the circuit and disabling the electrical operator for opening or closing the garage or warehouse door.

In preferred form, the device of the present invention comprises a frame in the form of a rectangular plane of a rigid material, such as wood or rigid plastic, having a rectangular opening substantially centered in the inside wall. This is designed to fit, in flush relation, surrounding the lock opening in the garage door frame, through which the lock bar or bolt is designed to penetrate when actuated. A pair of lead wires directed to opposite power terminals of the garage door operator control circuit, are respectively interposed along the inside lateral edges of the frame on opposite sides of the rectangular opening, terminating in a pair of outwardly directed contacts disposed on opposite sides, near the lower end of the opening.

A trap door or gate, also of rigid material, such as wood or plastic, is disposed to open outwardly and close toward the outside face of the opening. The gate is suspended from a pair of bearings which are rotatably supported on a rod interposed transversely across the upper end of the frame above the opening, and is spring-biased by two torsion type coil springs threaded onto the rod. A conducting metal block is disposed widthwise across the outer surface at the lower end of the gate. This conducting metal block is electrically connected at its opposite ends through the thickness of the gate to a pair of contacting surfaces at opposite ends on the under surface of the gate. These contacting surfaces are designed to mate, in normally-closed position of the gate, with contacts on opposite legs of the frame.

Thus, when the lock bar or bolt is actuated, it enters the lock opening, immediately contacting the underside of the gate, which may have been thickened in cross-section in its central portion, instantly breaking the circuit to the electrical operator for opening and closing the garage doors.

A particular feature of the invention is that the gate, in addition to being spring-biased, is wedge-shaped and counter-wieghted, so that it tends to return to normally closed condition unless pushed-open by the lock bar.

The switch of the present invention has the advantage of being simple to manufacture, since it comprises only a few simple parts, and can be installed by merely bolting or otherwise securing it to the garage door frame over the hole for the garage lock bar or bolt, and connecting the terminal wires of the switch between the power source and the transformer primary or secondary of the electrical garage door operator, or at any other convenient circuit position.

A particular advantage of the cut-off switch of the present invention is that it operates immediately, upon contact by the lock bar or bolt to cut off the power from the garage door operator, thereby preventing any possible damage. Another advantage of the switch of the present invention is that because of its unlimited 'throw' when the switch is opened, it accommodates lock bars and bolts of many different sizes, and distances of traverse, thereby further simplifying the design criteria.

Another advantage of the switch of the present invention is that because it includes, in preferred form, two torsion springs and a counter-weighted, wedge-shaped gate, the gate will tend to be secure, even if both springs are broken, making it substantially impossible for the switch to malfunction.

These, and other objects, features and advantages will be better understood with reference to the attached drawings and the detailed description hereinafter.

SHORT DESCRIPTION OF THE DRAWINGS

DETAILED DESCRIPTION OF THE DRAWINGS

Figure 1:
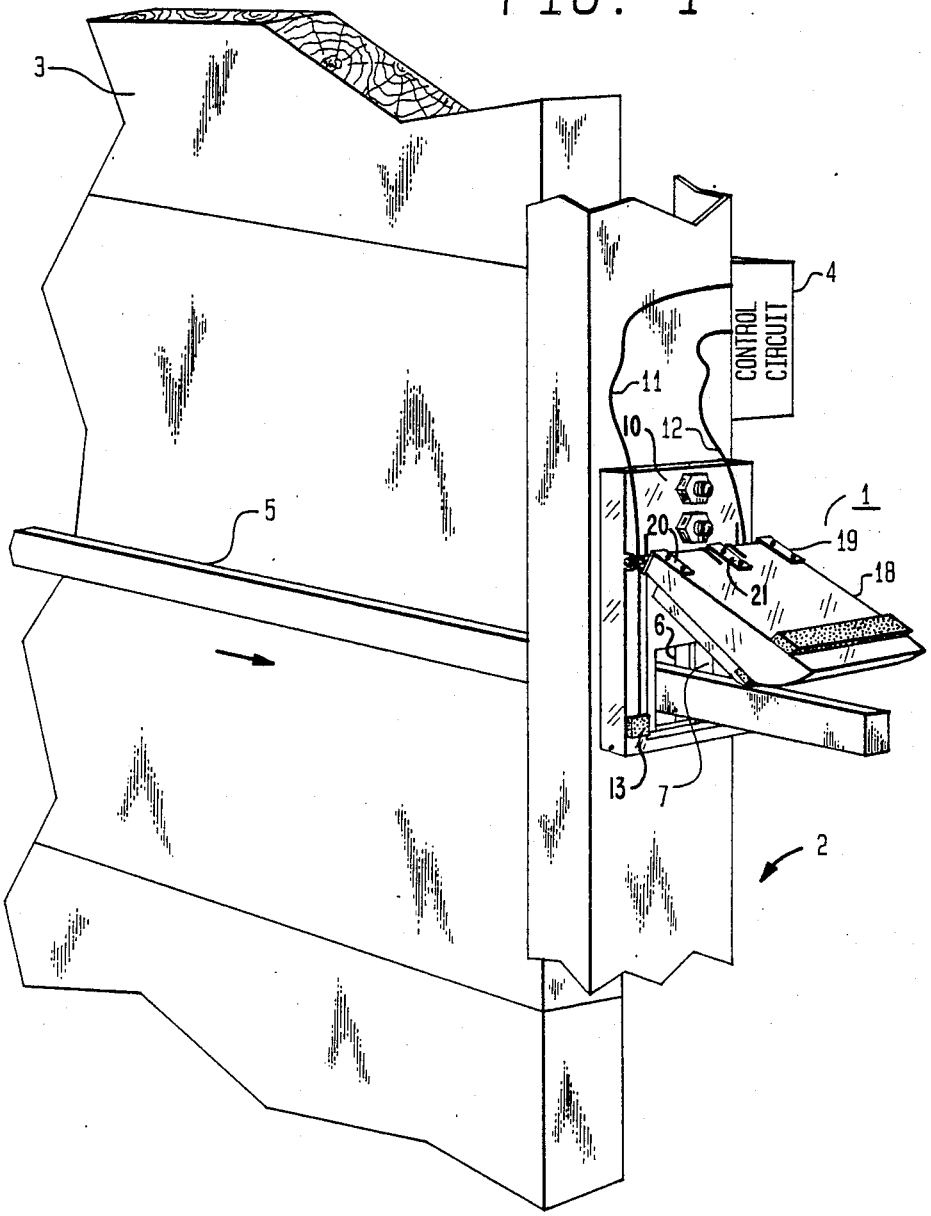
FIG. 1 is a showing of the cut-off switch of my invention installed on a garage door frame, being operated by the garage door locking bar.

Referring to FIG. 1 of the drawings, the cut-off switch of the present invention is shown installed on the garage door frame 2 of a typical garage door 3 of the type which is constructed to be raised and lowered by a remotely actuated electrical control circuit, indicated by the block diagram 4, of a type well-known in the art, which includes an electrical motor-driven gear system, and a receiver of command signals from a radio transmitter or push button. The switch 1 is disposed so that the rectangular switch opening 7 registers with lock hole 6 which is drilled transversely through the garage door frame 2 and is constructed to accommodate the lock bar 5. The latter is constructed to move to the right, as indicated in the drawing, and engage lock hole 6 when the conventional garage door lock has been actuated by turning the garage door lock handle to locked position, thereby preventing the garage door 3 from being raised.

Figure 3:
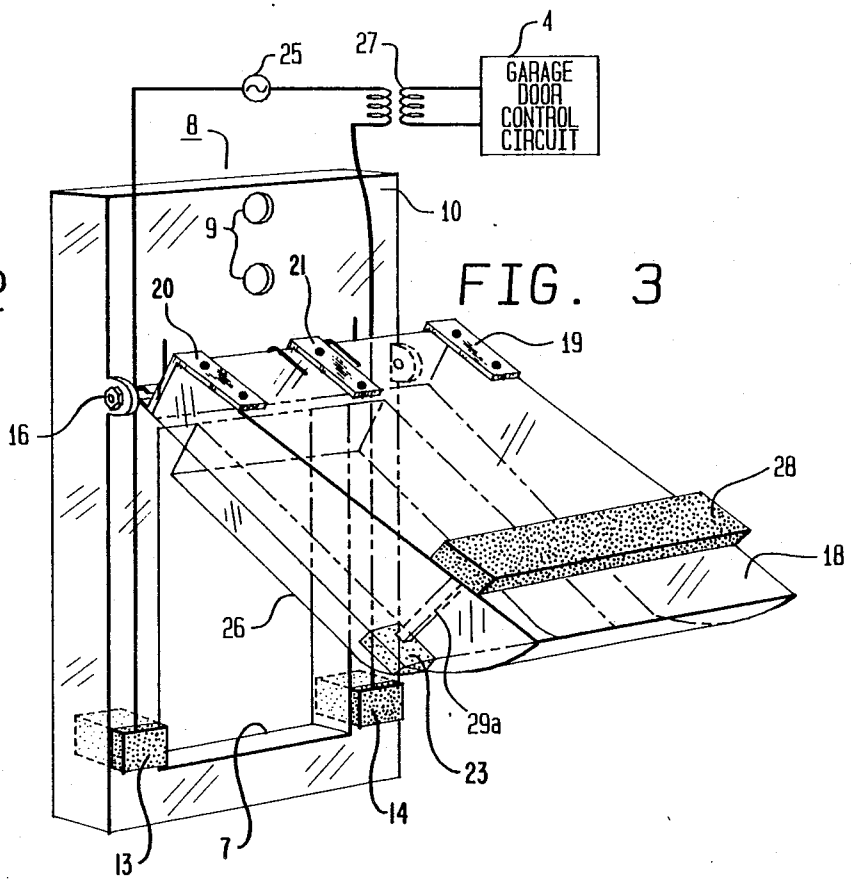
FIGS. 2 and 3 are isometric showings, viewed from the front side of the switch, in closed and open positions, respectively.
Figure 2:
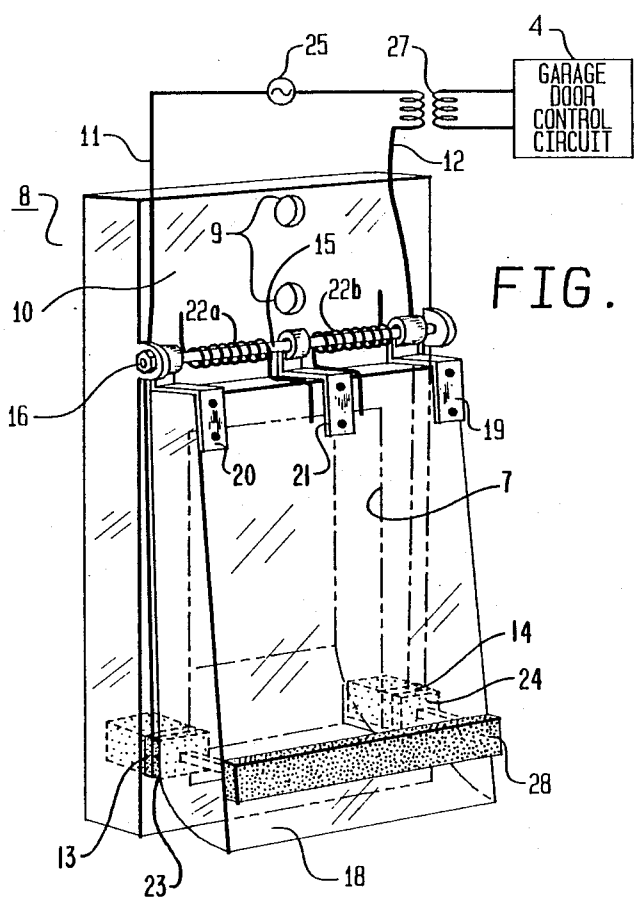

Referring to FIGS. 2 and 3 which show an illustrative embodiment of the switch 1 in perspective, the housing 8 of the switch 1 comprises a gate 18 suspended in fixed frame 10. The latter takes the form of a rectangular block which may be formed of any rigid non-electrially conductive material, such as, for example, any of the rigid plastic materials well-known in the art, such as an acrylic resin manufactured by the Du Pont Company under the trademark 'PLEXIGLAS', which has been selected for the purposes of the present illustrative embodiment because it is transparent, enabling the working elements of the switch to be clearly illustrated. It will be understood that other rigid insulating material would also be suitable.

The housing 8 has, for example, an overall length of, say, $4\frac{3}{8}$ inches, a width of, say, 2 7/16 inches, and a thickness of say, $\frac{5}{8}$ inch.

Figure 7:
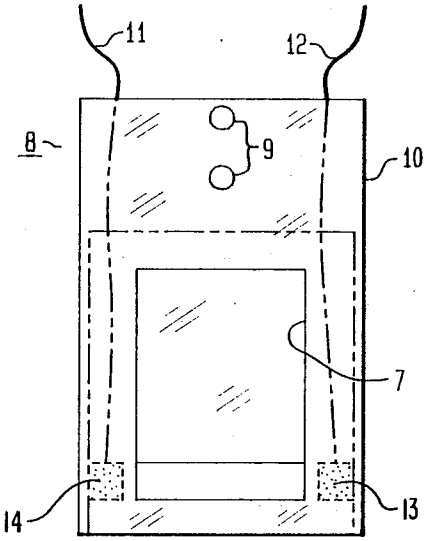
FIG. 7 is a view from the open side of the frame or housing of the switch of the present invention with the door removed to show the lead wires connected to the contact points.

The upper end of the housing 8 has a pair of bolt holes 9 centered in spaced-apart relation, through its thickness for securing the housing to the garage door frame 2. Below the bolt holes 9, centered about the long axis of the body 8 is the rectangular frame opening 7 which, may be, for example $1\frac{1}{2}$ inches wide and, say, $2\frac{1}{4}$ inches long, or longer, the upper edge being $1\frac{3}{4}$ inches below the top, and the lower edge being $\frac{3}{4}$ inch above the bottom of housing 8. The size of the opening 7 should be substantially larger than the lock hole 6, and disposed, so that when housing 8 is bolted in place with its rear surface in flush relation against the outer surface of door frame 2, the perimeter of lock hole 6 is surrounded by and is substantially equidistant from the top and sides of opening 7. The opening 7 goes through the thickness of housing block 8, and is therefore $\frac{5}{8}$ inch deep from the front to the rear surface, in the present embodiment. FIG. 7 shows a rear elevation of housing 8, looking in through opening 7.

A pair of lead wires 11 and 12 are connected to the circuit of the electrical control circuit 4, indicated in block diagram in FIG. 1.

For convenience in the present illustrative embodiment, the lead wires 11 and 12 may be connected in circuit relation with the primary of power transformer which is powered from a conventional AC source 25 being connected through a pair of conventional terminals, not shown. It will be understood, however, that the switch 1 can be interposed at other points in the garage door electrical control circuit 4, so long as it serves to completely cut off power to the electrical control circuit 4 as soon as switch 1 is operated. In the present embodiment the lead wires 11 and 12 are respectively extended adjacent the inner left-hand and right-hand corners of housing 8, against the inner surface of housing 8 adjacent opposite corners, terminating in frame contacts 13 and 14 which take the form of small block conducting elements of copper, or the like, $\frac{1}{4}$ inch square and $\frac{1}{8}$ inch thick, located on opposite sides, near the lower end of opening 7.

About $\frac{1}{2}$ inch down from the top of housing 8, and well above the upper edge of the opening, a rod or axial member 15, such as an elongated bolt, is interposed in fixed relation across the width of the housing 8, with its ends respectively secured in place near the open upper edge of the narrow side panels of housing 8 by a pair of nuts 16 and 17.

Figure 8:
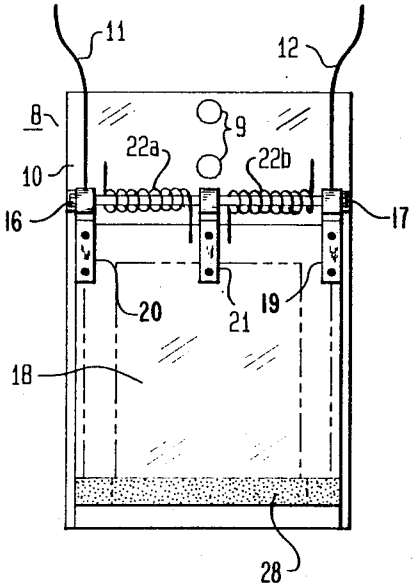
FIG. 8 is a view of the switch of my invention from the front with the door in place, showing the supporting bearings and coil spring bias.

A rectangular door or gate 18, which in the present illustrative embodiment is, say, three inches long and two inches wide, and $\frac{1}{2}$ inch thick at its lower edge and tapers to a thickness of $\frac{1}{4}$ inch at its upper edge. Door or gate 18 is formed of a rigid non-electrically conductive material, and is rotatably suspended from the rod 15 by two metal hinges 19 and 20, which are fastened parallel to and adjacent opposite long edges of gate 18, so that the upper end of each of the strips extend beyond the upper edge of 18, each forming a bearing which surrounds the rod 15 in rotatable relation. An additional hinge 21 is centered between hinges 19 and 20. Spring bias is imposed on the gate 18 by means of a pair of torsion type coil springs 22*a*, and 22*b*, threaded onto the rod 15, the ends of the coil springs respectively bearing against the inside panel surface 10, and the outside surface of the door or gate 18. FIG. 8 is a front elevation of the switch 1 which the gate 18 in place, in closed position.

Interposed into the thickness of the gate 18 at opposite points near the lower ends are a pair of metal gate contact members 23 and 24, comprising blocks of conducting metal, such as copper which are, say $\frac{1}{4}$ inch square and $\frac{1}{8}$ inch thick, which are positioned so that when the gate 18 is closed, they respectively register in electrical conducting contact with frame electrical contacts 13 and 14. The coil springs 22*a* and 22*b* are designed to impose a compression of at least about 5 pounds per square inch between frame contacts 13 and 14 and the respective gate contacts 23 and 24, when the gate is in its normally-closed position. An electrically conducting bar 28 of copper or other conducting metal, which is 2 inches long, ¼ inch wide and ⅛ inch thick, and weighs, say, 3½ ounces, is fastened transversely across the outer surface of the thick lower end of gate 18, parallel thereto. This is electrically connected at its opposite ends, through connecting members 29*a* and 29*b* extending through the thickness of gate 18 to the respective contact members 23 and 24, so that when gate 18 is closed, the power circuit to transformer primary 27 is closed, energizing the garage door electrical control circuit 4. The metal bar 28 serves an additional function as a counter-weight, which serves, together with the spring-bias imposed by torsion type coil springs 22*a* and 22*b*, to keep gate 18 in normally-closed condition, when not pushed open by the lock bolt 5.

In order to insure that the power circuit is immediately broken when the lock is actuated, and to further add to the counter-weighting of gate 18, a layer 26, say, ¼ inch thick of plastic, or other non-conducting material, may be fastened to its under face. The layer 26 is dimensioned to extend into opening 7 when the gate 18 is closed against frame 8.

Figure 6:
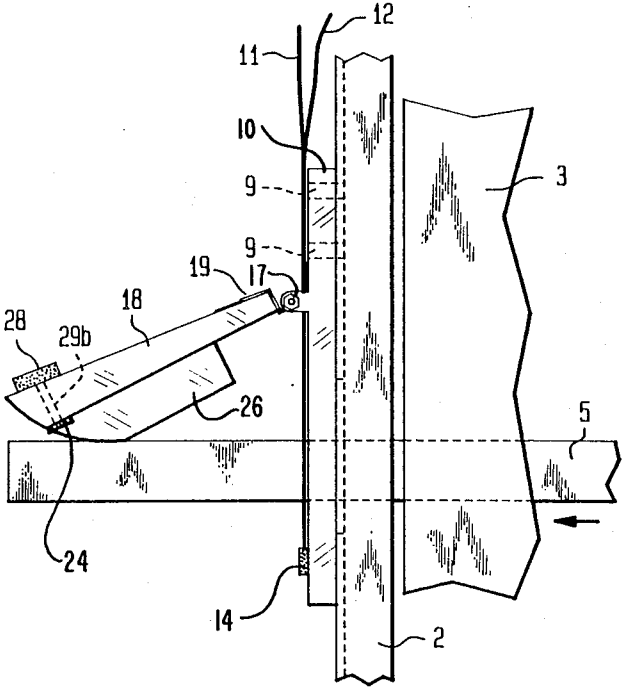
FIGS. 4, 5 and 6 are side-elevational views of the cut-off switch of my invention in closed, barely open, and far open positions respectively.
Figure 5:
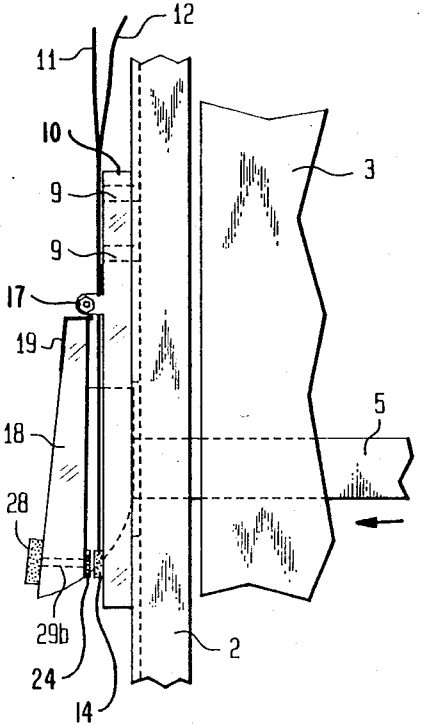
Figure 4:
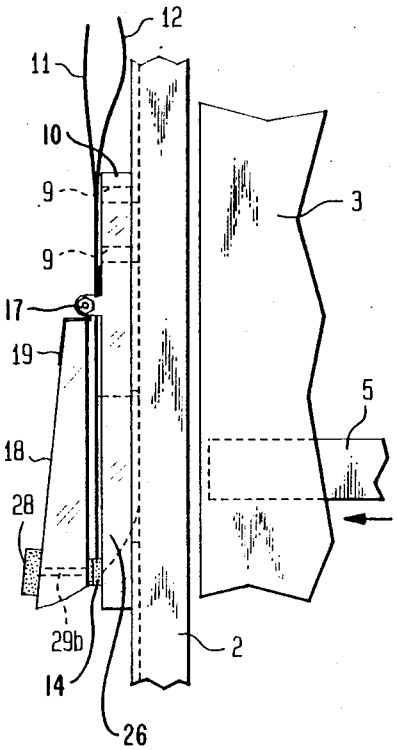

When the garage door is locked, moving the lock bar 5 to the right, the gate 18 is pushed open, immediately breaking contact between housing contacts 13 and 14, and respective gate contacts 23 and 24, thereby disabling the garage door electrical control circuit 4. FIGS. 4, 5 and 6 show the positions of the switch as the lock bar 5 moves from unlocked to locked position through opening 6. FIG. 4 shows the pre-contact position of lock bar 5. FIG. 5 shows the position of first contact by lock bar 5, with the underside of 26, interrupting contact with electrical control circuit 4 before the garage door mechanism is implemented. Finally, the position shown in FIG. 6 shows lock bar 5 fully implemented, extending far beyond the inner surface of garage door frame 2.

The following are particular advantageous features of the invention.

The switch, in unoperated position, is substantially flat, requiring a minimum of space.

The gate is wedge-shaped and counter-weighted, causing it to remain normally closed.

The gate hinges are off-set, changing the center line of the balancing force, which acts, together with the counter-weighting, to create pressure against the contact parts.

The use of the right-hand and left-hand wound torsion springs creates a torque on the off-set hinges, thereby differentiating from prior art types of switches which rely on compression or extension spring bias.

Since the switch is flat and has no back, as in the case of prior art switches, the lock bar or bolt is not prevented from traveling to its fullest extent.

The switch is completely fool-proof, since the instant a garage door becomes locked, the circuit is broken; and the instant the garage door is unlocked, the circuit is closed. Even if both springs are broken, the counter-weighted door will still operate to close the contacts.

The present invention is not to be construed as limited by the specific form of the present embodiment, which is described by way of illustration only, but only by the scope of the appended claims.

What is claimed is:

1. A lock operated cut-off switch for disabling the electrical controller for remotely-operated or push button operated garage or warehouse doors which comprise a lock bolt or bar which is propelled by a locking mechanism from a first position out of contact with a member fixed with reference to said garage or warehouse doors to a second position secured in a lock hole in said fixed member, said switch comprising in combination:

a frame having a frame opening which at least exceeds the lateral extent of said lock hole in the principal plane of said frame;

means for securing a rear surface of said frame to said fixed member so that said frame opening encompasses the perimeter of said lock hole;

a gate having a length and width which substantially exceeds the length and width of said frame opening and having an upper edge and a lower edge across said width;

hinge means fastened above said frame opening and constructed to support the upper edge of said gate to at least partially cover said frame opening, so that the lower edge of said gate is rotatable in an outward direction from said frame for uncovering said frame opening;

said frame including at its lower end a pair of frame electrical contacts disposed on opposite sides of said frame opening;

electrical conductors connected to each of said frame contacts, which conductors are respectively constructed and arranged to be connected in circuit relation to opposite terminals of the power circuit for said electrical controller;

a pair of gate contacts respectively connected adjacent to said lower edge near the opposite lower corners of said gate on its inner surface and constructed to respectively mate with said frame electrical contacts when said gate is closed;

conducting means including a portion disposed across the width of said gate for electrically connecting said gate electrical contacts; and spring-biasing means for biasing said gate in normally closed condition in which said gate electrical contacts are in contact with said frame electrical contacts.

2. The combination in accordance with claim 1 wherein the lower end of said gate includes counter-weight means to urge said gate to remain in normally-closed condition.

3. The combination in accordance with claim 2 wherein said gate is substantially wedge-shaped, the upper edge in contact with said hinge means having a substantially smaller thickness than said lower edge, thereby serving to counter-weight said gate.

4. The combination in accordance with claim 2 wherein said frame opening has a substantial thickness constructed to provide when said gate is closed, a recess between the outer surface of said frame and the outer surface of said member fixed with reference to said garage or warehouse doors, and wherein an auxiliary thickness member attached to the under surface of said gate is dimensioned to fit into and extend at least part way through the thickness of said recess when said gate is closed, thereby serving the dual function of providing counter-weighting to said gate and, providing immediate contact with a lock bolt traversing said lock hole, to cause the immediate opening of said lock-operated cut-off switch.

5. The combination in accordance with claim 2 wherein said conducting means disposed across the width of said gate comprises a metal bar which also serves as counter-weighting means.

6. The combination in accordance with claim 1 in which said spring-biasing means comprises one or more torsion springs connected between the upper edge of said frame opening and the upper end of said gate.

* * * * *